US006478154B2

(12) United States Patent
Cliff et al.

(10) Patent No.: US 6,478,154 B2
(45) Date of Patent: Nov. 12, 2002

(54) BOOK-LIKE DISPLAY SHOWCASE WITH TRANSPARENT ENCLOSURE BETWEEN FRONT AND BACK COVERS

(76) Inventors: Mary Lou Cliff, N6416 Fairy Springs Rd., Hilbert, WI (US) 54129; Kerry D. Cliff, N6416 Fairy Springs Rd., Hilbert, WI (US) 54129

( * ) Notice: Subject to any disclaimer, the term of this patent is extended or adjusted under 35 U.S.C. 154(b) by 39 days.

(21) Appl. No.: 09/799,979

(22) Filed: Mar. 6, 2001

(65) Prior Publication Data

US 2001/0035367 A1 Nov. 1, 2001

Related U.S. Application Data

(60) Provisional application No. 60/187,541, filed on Mar. 7, 2000.

(51) Int. Cl.[7] ..... B65D 73/00

(52) U.S. Cl. ..... 206/472; 206/232; 281/19.1

(58) Field of Search ..... 206/472, 474, 206/475, 232, 459.5; 281/19.1, 29, 31, 34

(56) References Cited

U.S. PATENT DOCUMENTS

| | | | | | |
|---|---|---|---|---|---|
| 219,563 | A | * | 9/1879 | Allen | 281/19.1 |
| 676,756 | A | * | 6/1901 | Miller | |
| 1,377,120 | A | | 5/1921 | Exline | |
| 1,868,029 | A | | 7/1932 | Steinthal | |
| 4,026,615 | A | | 5/1977 | Tazaki et al. | |
| 4,120,517 | A | | 10/1978 | Staats | |
| 4,164,085 | A | | 8/1979 | Steeb et al. | |
| 4,227,328 | A | | 10/1980 | Clipper, Jr. | |
| D271,063 | S | * | 10/1983 | Compton | 206/472 |
| D271,161 | S | | 11/1983 | Compton | |
| 4,434,567 | A | | 3/1984 | LeVeau | |
| 4,503,974 | A | | 3/1985 | Lane | |
| 4,765,466 | A | * | 8/1988 | Ivey | 206/232 |
| D311,220 | S | * | 10/1990 | Kam | D19/26 |
| 4,968,565 | A | | 11/1990 | Stefano | |
| 5,002,417 | A | | 3/1991 | Hsu C.S. | |
| 5,248,037 | A | | 9/1993 | Kornberg et al. | |
| 5,484,054 | A | | 1/1996 | Keyszewski | |
| 5,515,972 | A | * | 5/1996 | Shames | 206/232 |
| D380,927 | S | * | 7/1997 | Williams et al. | D6/632 |
| D386,677 | S | | 11/1997 | Abiteboul | |
| 5,775,489 | A | * | 7/1998 | Vickers | 206/307.1 |
| 5,997,041 | A | | 12/1999 | Tan | |
| D429,761 | S | | 8/2000 | Ward | |
| 6,109,657 | A | * | 8/2000 | Tan | 281/15.1 |
| 6,357,797 | B1 | * | 3/2002 | Lee | 281/19.1 |

* cited by examiner

*Primary Examiner*—Shian Luong
(74) *Attorney, Agent, or Firm*—John R. Flanagan; Flanagan & Flanagan

(57) ABSTRACT

A book-like display showcase includes an enclosure having an interior compartment for containing articles of memorabilia therein. The enclosure is made of a transparent material permitting the viewing and displaying of the articles of memorabilia through the enclosure from exterior thereof. The showcase also includes a covering assembly having front and back covers and a rear portion interconnecting the front and rear covers such that they are separate from one another and the enclosure and movable toward and away from opposite side portions of the enclosure. The middle portion is disposed along a rear portion of the enclosure and connected thereto and removably covers an opening defined through the rear portion of the enclosure through which the articles of memorabilia are inserted into and removed from the enclosure.

20 Claims, 3 Drawing Sheets

BOOK-LIKE DISPLAY SHOWCASE WITH TRANSPARENT ENCLOSURE BETWEEN FRONT AND BACK COVERS

This utility patent application claims the benefit of provisional application No. 60/187,541 filed Mar. 7, 2000.

BACKGROUND OF THE INVENTION

1. Field of the Invention

The present invention generally relates to a devices for storing and displaying memorabilia and, more particularly, is concerned with a book-like display showcase with a separate transparent enclosure between front and back covers of the showcase.

2. Description of the Prior Art

Over the years, a family typically accumulates many articles of memorabilia representing various important moments and occasions in life, such as wedding day, births, birthdays, graduations and so forth. Many articles of memorabilia, such as photographs and marriage and birth certificates, are stored in small boxes and photo albums. However, memorabilia are too often packed away in a trunk or a drawer and not seen for years at a time.

One most common device for storing a specific type of article of memorabilia, namely photographs, is a photo album. However, a photo album is typically not designed to display the photographs mounted on its pages during times other than when the photo album is opened specifically for the purpose of looking at its contents. Another common device for both storing and displaying a photograph or photographs is a picture frame.

However, neither photo albums nor picture frames are generally available for safely and concurrently storing and displaying a wide range of articles of memorabilia. U.S. Pat. No. 4,968,565 to Stefano discloses one such device in the form of a transparent tube with removable end caps and defining an internal volume adapted to receive and store one or more different articles of memorabilia. The transparent tube of the Stefano patent is thus capable of both safely storing and displaying articles of memorabilia at the same time.

However, the Stefano device basically is a special purpose ornament adapted to be hung on a Christmas tree or elsewhere. Consequently, there is a need for a more general purpose device capable of safely storing and displaying articles of memorabilia, which device can be placed in a variety of locations so as to serve its dual purposes.

SUMMARY OF THE INVENTION

The present invention provides a book-like display showcase designed to satisfy the aforementioned need. The book-like display showcase of the present invention is provided with a transparent enclosure between separate front and back covers of the showcase for receiving, storing and displaying many different articles of memorabilia therein in a safe and protected manner. The showcase is adapted to be placed in a variety of locations. It can rest open on a shelf, be freestanding or lie flat on a shelf, stored on a shelf with other books, or can incorporate a chain and hook so that it can hang from some structure, such as a Christmas tree or shelf.

Accordingly, the present invention is directed to a book-like display showcase which comprises: (a) an enclosure having an interior compartment for containing articles of memorabilia therein, the enclosure being substantially made of a transparent material permitting the displaying and viewing of the articles of memorabilia through the enclosure from exterior thereof; and (b) a covering assembly having a front cover, a back cover and a middle portion extending between and interconnecting the front and back covers and disposed along a rear portion of the enclosure and connected thereto such that the front and back covers are separate from one another and from the enclosure and movable toward and away from opposite side portions of the enclosure. The enclosure also has an opening defined through the rear portion thereof permitting insertion and removal of articles of memorabilia through the opening into and from the enclosure.

The showcase also comprises means for removably connecting the middle portion of the covering assembly to the rear portion of the enclosure so as to removably cover the opening defined through the rear portion of the enclosure. The enclosure has top and bottom walls, opposite side walls and a front wall all arranged and interconnected to one another in a generally rectangular configuration so as to form the interior compartment of the enclosure. Preferably, each wall is transparent to permit the viewing and displaying of the articles of memorabilia in the interior compartment through any of the walls of the enclosure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
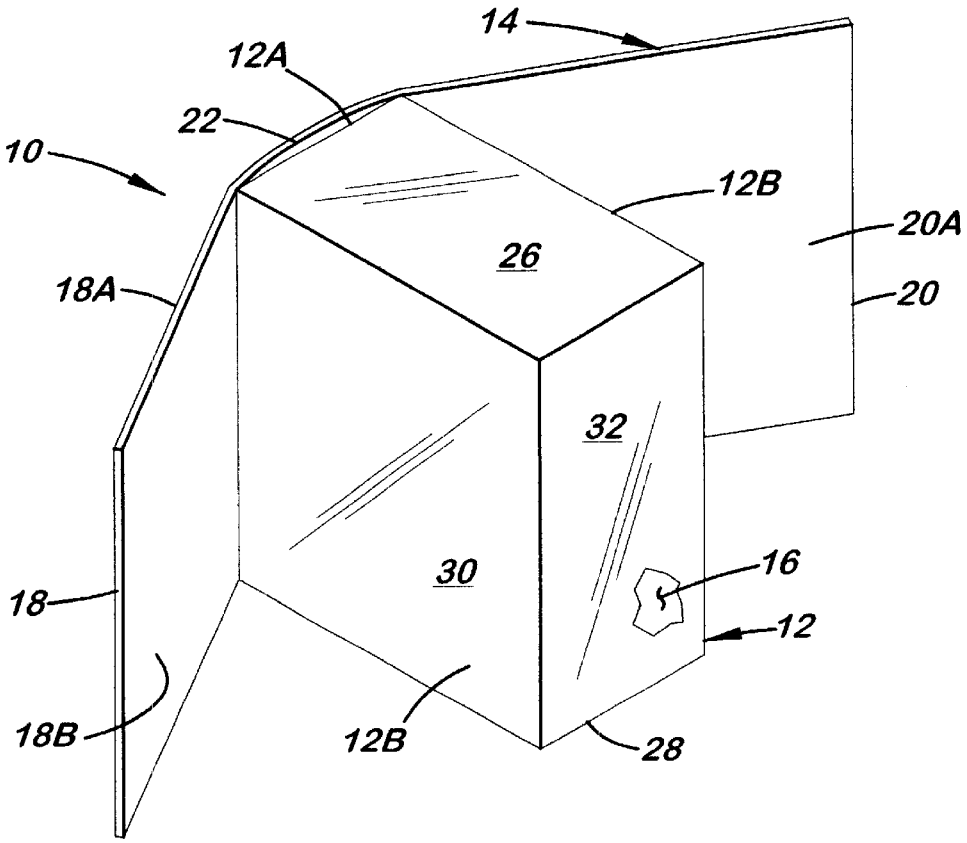
FIG. 1 is a top perspective view of a book-like display showcase of the present invention with a separate transparent enclosure between front and back covers of a cover assembly of the showcase.
Figure 2:
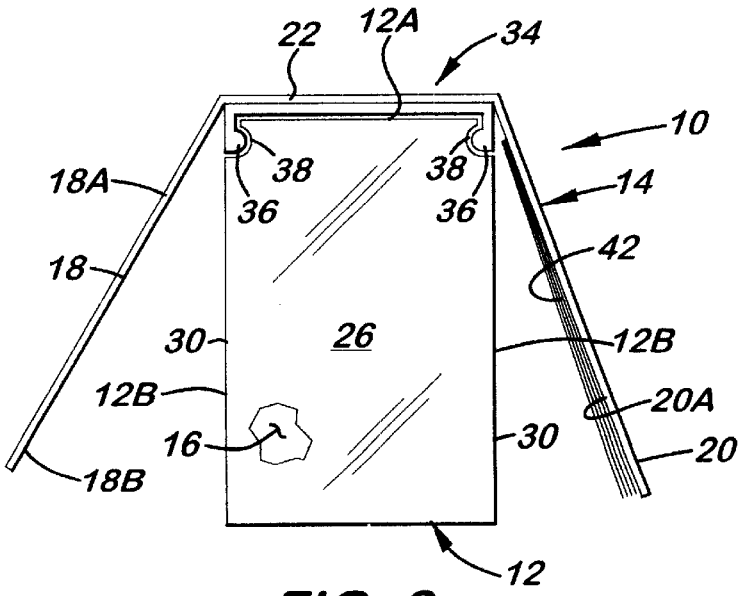
FIG. 2 is a top plan view of the showcase showing the cover assembly slidably removably connected to a rear portion of the transparent enclosure of the showcase to expose a rear opening through the rear portion of the enclosure.
Figure 3:
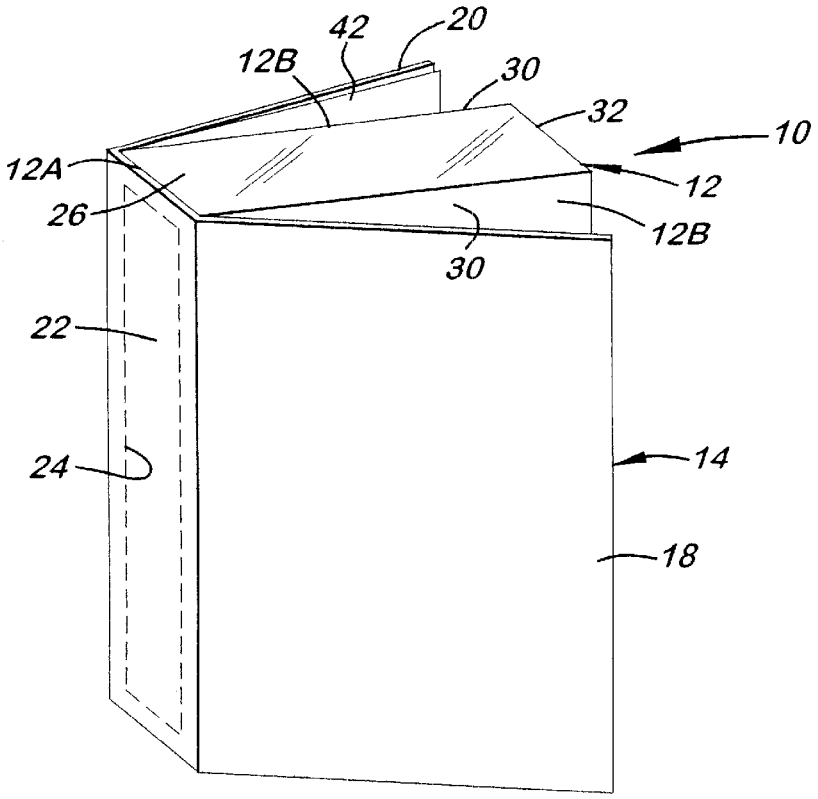
FIG. 3 is a rear perspective view of the showcase showing in dashed outline the opening in the rear portion of the enclosure.

Referring to the drawings and particularly to FIGS. 1 to 3, there is illustrated a book-like display showcase of the present invention, generally designated 10. The display showcase 10 basically includes an enclosure 12 and a cover assembly 14. The enclosure 12 has an interior compartment 16 for containing articles of memorabilia (not shown) therein. The enclosure 12 is made substantially of a transparent material that permits viewing and displaying of the articles of memorabilia in the interior compartment 16 through the enclosure 12 from the exterior thereof. The covering assembly 14 has a front flap or cover 18, a back flap or cover 20 and a spine or middle portion 22 extending between and interconnecting the front and back covers 18, 20. The middle portion 22 is disposed along a rear portion 12A of the enclosure 12 and connected thereto. The front and back covers 18, 20 are separate from the enclosure 12 and movable toward and away from the opposite side portions 12B of the enclosure 12. The front and back covers 18, 20 are separated from one another by the middle portion 22. Further, the enclosure 12 has an opening 24 through the rear portion 12 thereof (or any other suitable location) permitting insertion and removal of articles of memorabilia into and from the interior compartment 16 of the enclosure 12.

More particularly, the enclosure 12 of the showcase 10 has top and bottom walls 26, 28, opposite side walls 30 and a front wall 32 all arranged and interconnected to one another in a generally rectangular configuration so as to form the interior compartment 16 containing the articles of memorabilia. At least some, and preferably all, of the walls 26, 28, 30, 32 of the enclosure 12 are made of the transparent material to permit the viewing and displaying of the articles of memorabilia in the interior compartment 16 through any of the transparent walls 26, 28, 30, 32 of the enclosure 12 from exterior thereof. The material from which the transparent enclosure 12 is made can be either glass or a plastic such as acrylic. The front and back covers 18, 20 of the covering assembly 14 can be either rigid or flexible and are movable toward and away from the opposite side walls 30 of the enclosure 12. The opening 24 defined through the rear portion 12A of the enclosure 12 is opposite from the front wall 32 thereof for permitting insertion and withdrawal of the articles of memorabilia through the opening 24 into and from the interior compartment 16 of the enclosure 12.

The showcase 10 further includes mean 34 for removably connecting the middle portion 22 of the covering assembly 14 to the rear portion 12A of the enclosure 12 so as to removably cover the opening 24 defined through the rear portion 12A of the enclosure 12. The removably connecting means 34 preferably includes first fastening elements 36 on the rear portion 12A of the enclosure 12 and second fastening elements 38 on the middle portion 22 of the covering assembly 14. The first and second elements 36,38 can be attachable together and detachable apart so as to removably attach to the rear portion 12A of the enclosure such that the middle portion 22 of the covering assembly 14 removably covers the opening 24 in the rear portion 12A of the enclosure 12.

In an exemplary embodiment shown in FIG. 2, the first and second fastening elements 36, 38 interfit with one another so as to allow the cover assembly 14 to slide up or down onto or from the rear portion 12A of the enclosure 12. The first and second elements 36, 38 can be interfittable tongue and groove elements. Other alternative removably connecting means 34 can be employed, for example, snaps using a soft flexible type of material, such as rubber, or complementary hook and loop connecting members on the middle portion 22 and rear portion 12A of the enclosure 12 or hinge and locking clasp elements arranged at respective intersections of the front and back covers 18, 20 with the opposite side walls 30 of the enclosure 12 or at respective intersections of the upper and lower edges the middle portion 22 with the top and bottom walls 26, 28 of the enclosure 12.

Figure 4:
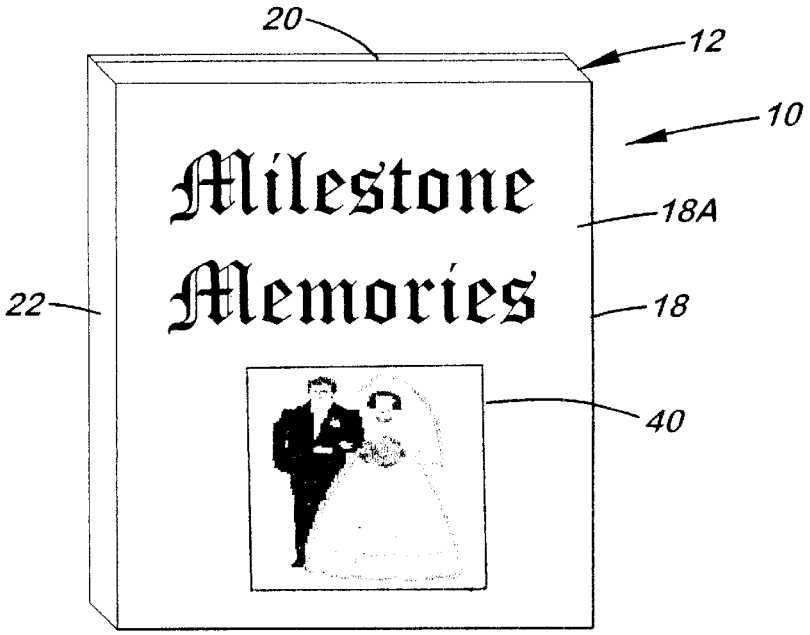
FIG. 4 is a front perspective view of the showcase showing a trademark and a photograph applied on the exterior surface of the front cover of the showcase cover assembly.
Figure 5:
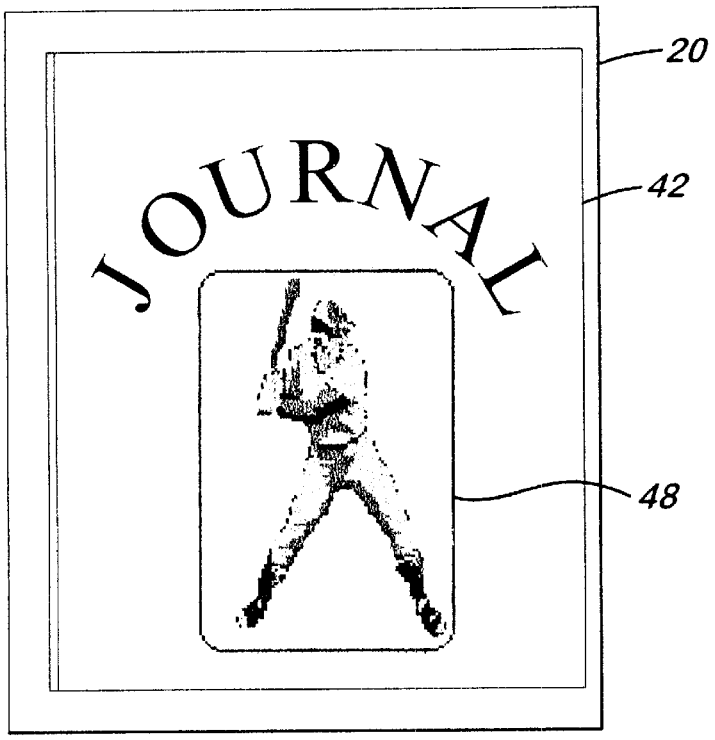
FIG. 5 is a plan view of a back cover of the showcase showing a front page or cover of a journal that is mounted on the interior surface of the back cover of the showcase cover assembly.
Figure 6:
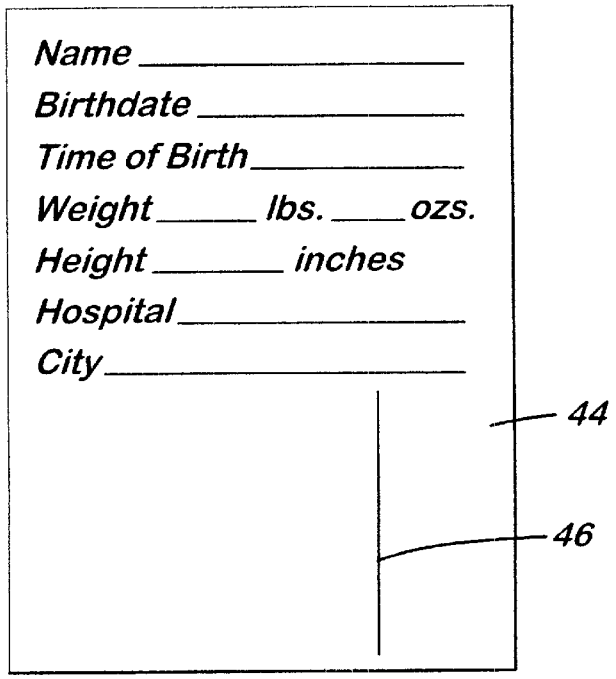
FIG. 6 is a plan view of a front cover of the showcase showing a fill-in-the-blank record sheet mounted on the interior surface of the front cover of the showcase cover assembly.

Referring to FIGS. 4 to 6, there is shown other optional features of the showcase 10. In FIG. 4, the exterior surface 18A of the front cover 18 of the covering assembly 14 is shown having, as examples, a trademark such as "Milestone Memories" and a photograph 40 applied thereon. In FIG. 5, an interior surface 20A of the back cover 20 (alternatively could be on the interior surface 18B of the front cover 18) is shown having a set of pages 42 mounted (detachably or otherwise) thereto in which to keep a journal or make notes. In FIG. 6, the interior surface 18B of the front cover 18 (alternatively could be on the interior surface 20A of the back cover 20) is shown having a fill-in-the-blank record sheet 44 mounted (detachably or otherwise) thereto and preprinted with blanks on which to record information. The pages 42 and sheet 44 can have slots 46 and pockets 48 thereon for insertion of photographs. Other indicia and media could be employed on these and other portions of the showcase 10 as desired. The showcase 10 also could be marketed as a series representing different time periods such as: birth; school-age years, marriage; and bereavement of a loved one. Some possible memorabilia that can be stored and displayed in the showcase 10 could include: newspaper clippings of birth announcement, baby's first photo, baby's first pacifier, hospital wrist band, first bootie, lock of hair from first haircut, candle from first year birthday cake, handprint, medals and/or awards, newspaper photos and articles, photos, garter, matchbook, prayer card, etc.

As an example, the cover assembly 14 of the showcase 10 could be manufactured as a single component with bend creases made to provide the front cover 18, back cover 20 and middle portion 22 therebetween. The tongue portion 36 could then be attached to the middle portion 22 by suitable means such as rivets or glue to keep them solidly connected together.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A book-like display showcase, comprising:

(a) an enclosure having an interior compartment for containing articles of memorabilia therein, said enclosure being substantially made of a transparent material permitting displaying and viewing of the articles of memorabilia through said enclosure from exterior thereof; and (b) a covering assembly having a front cover, a back cover and a middle portion extending between and interconnecting said front and back covers and disposed along a rear portion of said enclosure and connected thereto such that said front and back covers are separate from one another and from said enclosure and movable toward and away from opposite side portions of said enclosure.

2. The showcase of claim 1 wherein said enclosure has an opening permitting insertion and removal of articles of memorabilia through said opening into and from said enclosure through.

3. The showcase of claim 2 wherein said opening of said enclosure is defined through said rear portion thereof.

4. The showcase of claim 3 further comprising:

(c) means for removably connecting said middle portion of said covering assembly to said rear portion of said enclosure so as to removably cover said opening defined through said rear portion of said enclosure.

5. The showcase of claim 4 wherein said removably connecting means includes first fastening elements on said rear portion of said enclosure and second fastening elements on said middle portion of said covering assembly, said first and second elements being attachable together and detachable apart so as to removably attach to said rear portion of said enclosure and removably cover said opening in said rear portion of said enclosure.

6. The showcase of claim 5 wherein said first and second elements interfit with one another so as to allow said cover assembly to slide up or down onto or from said rear portion of said enclosure.

7. The showcase of claim 6 wherein said first and second elements are interfittable tongue and groove elements.

8. The showcase of claim 1 wherein an interior surface of one of said front and back covers has a portion thereon preprinted with blanks on which to record information.

9. The showcase of claim 1 wherein an interior surface of one of said front and back covers has pages removably attached thereto in which to keep a journal or make notes.

10. The showcase of claim 1 wherein said enclosure is made of plastic.

11. The showcase of claim 1 wherein said enclosure is made of glass.

12. A book-like display showcase, comprising:

(a) an enclosure having top and bottom walls, opposite side walls and a front wall all arranged and interconnected to one another in a generally rectangular configuration so as to form an interior compartment containing articles of memorabilia, at least some of said walls of said enclosure being made of a transparent material permitting the viewing and displaying of the articles of memorabilia through said transparent ones of said enclosure walls from exterior thereof; and (b) a covering assembly having a front cover, a back cover and a middle portion extending between and interconnecting said front and back covers and disposed along a rear portion of said enclosure and connected thereto such that said front and back covers are separate from one another and from said enclosure and movable toward and away from said opposite side walls of said enclosure.

13. The showcase of claim 12 wherein each of said walls of said enclosure are transparent to permit said viewing and displaying of the articles of memorabilia in said interior compartment through any of said walls of said enclosure.

14. The showcase of claim 12 wherein said enclosure has an opening defined through said rear portion of said enclosure opposite from said front wall thereof for permitting insertion and removal of the articles of memorabilia through said opening into and from said interior compartment of said enclosure.

15. The showcase of claim 14 further comprising:

(c) means for removably connecting said middle portion of said covering assembly to said rear portion of said enclosure so as to removably cover said opening defined through said rear portion of said enclosure.

16. The showcase of claim 15 wherein said removably connecting means includes first fastening elements on said rear portion of said enclosure and second fastening elements on said middle portion of said covering assembly, said first and second elements being attachable together and detachable apart so as to removably attach to said rear portion of said enclosure and removably cover said opening in said rear portion of said enclosure.

17. The showcase of claim 16 wherein said first and second elements interfit with one another so as to allow said cover assembly to slide up or down onto or from said rear portion of said enclosure.

18. The showcase of claim 17 wherein said first and second elements are interfittable tongue and groove elements.

19. The showcase of claim 12 wherein an interior surface of one of said front and back covers has a portion thereon preprinted with blanks on which to record information.

20. The showcase of claim 12 wherein an interior surface of one of said front and back covers has pages removably attached thereto in which to keep a journal or make notes.

* * * * *